US005307107A

United States Patent [19]

Nozawa et al.

[11] Patent Number: 5,307,107

[45] Date of Patent: Apr. 26, 1994

[54] REPLENISHER SUPPLYING APPARATUS FOR PHOTOGRAPHIC PROCESSOR

[75] Inventors: Ryouei Nozawa; Akira Sugiyama, both of Kanagawa, Japan

[73] Assignee: Fuji Photo Film Co., Ltd., Kanagawa, Japan

[21] Appl. No.: 822,808

[22] Filed: Jan. 21, 1992

[30] Foreign Application Priority Data

Jan. 18, 1991 [JP] Japan ..... 3-004672

[51] Int. Cl.[5] ..... G03D 3/02

[52] U.S. Cl. ..... 354/324

[58] Field of Search ..... 354/319-324; 222/23, 53, 52, 56, 58; 134/64 R, 64 P, 122 R, 122 P

[56] References Cited

U.S. PATENT DOCUMENTS 3,927,417 12/1975 Kinoshita et al. ..... 354/298
5,184,164 2/1993 Kose et al. ..... 354/298
5,185,623 2/1993 Mogi ..... 354/324 X

*Primary Examiner*—D. Rutledge

*Attorney, Agent, or Firm*—Sughrue, Mion, Zinn, Macpeak & Seas

[57] ABSTRACT

A replenisher supplying apparatus for use in a photographic processor having a processing tank to which pieces of a photosensitive material are consecutively transported for processing, so as to supply replenishers to the processing tank. The apparatus includes stock tanks to which the replenishers are respectively supplied and which are respectively provided with level sensors; pumps for supplying the replenishers from the stock tanks to the processing tank; a controller arranged such that when it is detected by any of the level sensors that the liquid level is at a predetermined level or below, the controller stops the driving of the pump for the stock tank whose solution level has dropped to the predetermined level or below, while the controller continues to drive the remaining pumps until a drop in the level to the predetermined level or below is detected by the remaining level sensors; and a correcting device for correcting the sending capabilities of the pumps on the basis of the amount of each of the replenishers supplied during each of the continuous driving operations of the pumps driven continuously.

20 Claims, 14 Drawing Sheets

REPLENISHER SUPPLYING APPARATUS FOR PHOTOGRAPHIC PROCESSOR

BACKGROUND OF THE INVENTION

1. Field of the Invention

The present invention relates to a replenisher supplying apparatus for a photographic processor for processing a photosensitive material to which pieces of the photosensitive material are consecutively transported, so as to process the photosensitive material with optimum processing solutions by supplying replenishers stored in stock tanks to a processing tank by mixing them at an optimum ratio.

2. Description of the Related Art

In a photographic processor such as an automatic processor for processing a photosensitive material such as a photographic film, replenishing solutions or replenishers to be replenished to a developing tank and a fixing tank are prepared as undiluted replenishers filled in a cartridge are mixed and diluted. The cartridge is loaded on a solution pan.

The interior of the cartridge is partitioned so that a plurality of kinds of replenishers can be accommodated separately therein. At the same time, the solution pan in which the cartridge is loaded is also provided with partition walls and is partitioned into a plurality of filling tanks. Each of the filling tanks is provided with a pipe coupling. This pipe coupling is fitted to an end of a pipe. The other end of the pipe is connected to each stock tank, so that the filling tanks communicate with the respective stock tanks. For this reason, the solution levels of the undiluted replenishers in the filling tanks in the solution pan and the undiluted replenishers in the stock tanks are constantly made level by atmospheric pressure. Accordingly, as the undiluted replenishers are supplied from the stock tanks through each of electric pumps to the processing tank directly or to a mixing tank located upstream thereof, the undiluted replenishers are supplied gradually from the filling tanks to the stock tanks via the pipes, respectively.

When the undiluted replenishers in the filling tanks in the solution pan run short, the respective solution levels of the undiluted replenishers in the stock tanks drop. This drop in the solution level is detected by each level sensor when the level falls below a predetermined level, making it possible to ascertain the timing of replacement of the cartridge. Flow rates of the pumps are normally factory-adjusted before their shipment to ensure that the undiluted replenishers in the stock tanks will be supplied to the processing tank at fixed flow rates. That is, the pumps are so adjusted that the solution levels will fall below the predetermined values, simultaneously.

However, there are cases where the flow rates of the pumps for supplying the undiluted replenishers decline while the processor is used for long periods of time. The degree of the drop of the flow rates varies depending on each pump, so that the times when the solution levels in the stock tanks drop below the predetermined values do not coincide. This lack of coincidence results in an imbalance of the mixing ratio or concentration of replenishers, which leads to the problem that it becomes impossible to supply optimum processing solutions to the processing tank.

SUMMARY OF THE INVENTION

Accordingly, it is an object of the present invention to provide a replenisher supplying apparatus for a photographic processor capable of correcting a decline in the operating capabilities of pumps and supplying optimum processing solutions to a processing tank without causing an imbalance in the mixing ratio or concentration of replenishers, thereby overcoming the above described drawbacks of the conventional art.

The present invention provides a replenisher supplying apparatus for use in a photographic processor having a processing tank to which pieces of a photosensitive material are consecutively transported, and for supplying replenishers respectively stored in a plurality of stock tanks to the processing tank, the replenisher supplying apparatus comprising: a plurality of level sensors respectively disposed in the plurality of stock tanks for respectively detecting liquid levels of the replenishers in the plurality of stock tanks; a plurality of pumps disposed in correspondence with the plurality of stock tanks for supplying the replenishers from the plurality of stock tanks to the processing tank; control means for controlling the plurality of pumps in such a manner as to supply a predetermined amount of each of the replenishers in correspondence with an amount of the photosensitive material processed, the control means being so arranged that when any of the plurality of level sensors has detected the liquid level being at a predetermined level or below, the control means stops the driving of the pump provided in the stock tank whose level sensor has detected the level being at the predetermined level or below, and the control means controls the pumps corresponding to the stock tanks in which the remaining level sensors are disposed, in such a manner as to continuously drive the other pumps until the remaining level sensors detect a drop in the level to the predetermined level or below; and correcting means for correcting the flow rates of the pumps by measuring the amount of each of the replenishers supplied by the pumps during each of the continuous driving operations of the pumps to detect the degree of decline in the flow rate of each of the pumps and by acting on the control means on the basis of the measured amount so as to increase the flow rate.

In accordance with the replenisher supplying apparatus arranged as described above, during the time when the amounts of replenishers sent by the plurality of pumps are maintained at initially set rates, the undiluted replenishers in the stock tanks decrease by fixed amounts, respectively, even if the pumps are driven independently by the control means. For this reason, the level sensors simultaneously detect the solution levels in the stock tanks having dropped to the predetermined levels. In such a case, the replenishers in replenisher accommodating sections to which the replenishers are respectively supplied by fixed amounts are simultaneously consumed. Accordingly, a plurality of cartridges can be replaced simultaneously if, for instance, the replenishers are supplied to the replenisher accommodating sections by means of the plurality of cartridges in which predetermined amounts of replenishers are respectively accommodated. In addition, if one cartridge having a plurality of partitioned chambers respectively filled with the replenishers is used, the replenishers in the partitioned chambers are consumed simultaneously, so that any replenisher which might otherwise remain among the replenishers is prevented from being wasted.

However, there are cases where the flow rates of the pumps decline due to extended periods of use. The degree of the decline in the flow rates varies depending on the respective pump. When the drop in the liquid level in a relevant stock tank to a predetermined level or below is detected by the level sensor of that stock tank, the control means stops the operation of the pump corresponding to that stock tank, and continuously drives the remaining pumps corresponding to the remaining stock tanks until the drop in the liquid level to the predetermined level or below is detected by the respective level sensors of the remaining stock tanks. The flow rates of the respective pumps can be ascertained from the continuously driven time durations of the pumps, from the amounts of the liquids flowing, or the like. When a new cartridge is loaded, on the basis of that result, the correcting means corrects the actual flow rates of the deteriorated pumps by a difference between the flow rates of the respective pumps and that of the pump which was stopped by a sensor which firstly detected the predetermined level. This correction can be accomplished by changing the pump driving time for operation or by changing the amount of the replenishers in a unit time. As a result, the pumps are capable of supplying corresponding replenishers in optimum amounts irrespective of a decline in the flow rates of any of the pumps.

In addition, in the present invention, alarming means may be further provided for issuing an alarm when the time corrected by the correcting means has exceeded a first predetermined time limit.

This alarm means may be adapted to issue an alarm when a newly corrected predetermined time has exceeded a second time limit set on the basis of the predetermined time corrected previously.

In addition, the alarm means may be adapted to issue an alarm when a predetermined time corrected by the correcting means a plurality of times has exceeded a third predetermined time limit set on the basis of the predetermined time.

The amount of each of the replenishers supplied during the aforementioned continuous driving operation may be measured on the basis of a result of measurement of the continuous driving operation by means of a timer, or may be directly determined by using a flow meter.

In addition, storage means may be provided for storing the time measured by the timer, so that measured time durations are stored continuously a plurality of times in the storage means, so as to determine the amount of each of the replenishers supplied during the aforementioned continuous driving operation on the basis of an average value of the time durations measured the plurality of times.

The above and other objects, features and advantages of the invention will become more apparent from the following detailed description of the invention when read in conjunction with the accompanying drawings.

DESCRIPTION OF THE PREFERRED EMBODIMENT

Referring now to the accompanying drawings, a description will be given of an automatic processor 10 to which the present invention is applied.

Figure 1:
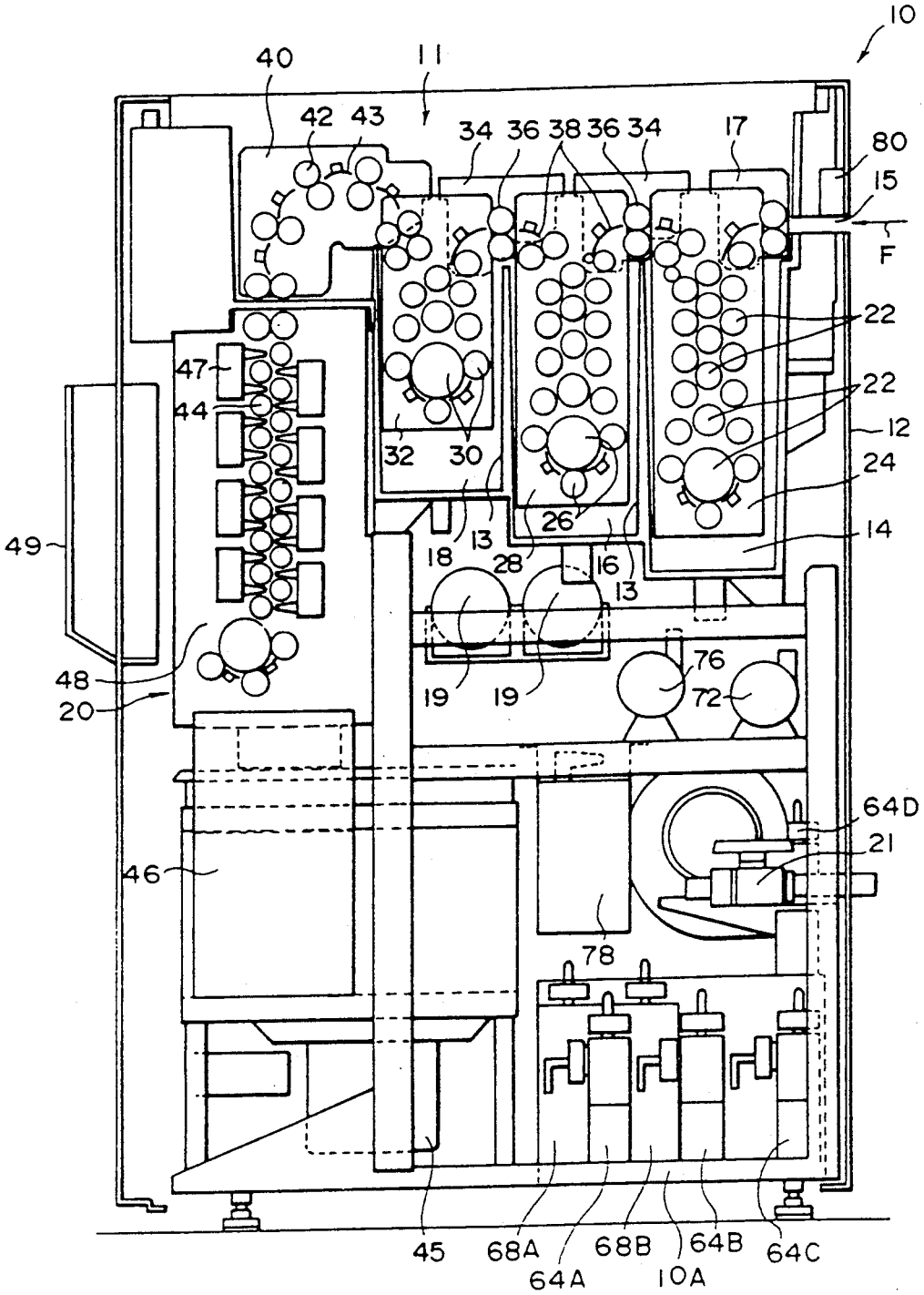
FIG. 1 is a cross-sectional view of essential portions of an automatic processor to which the present invention is applied.

As shown in FIG. 1, a processing section 11 in which a photographic material is processed by processing solutions and a drying section 20 in which the photographic material in wet condition by the solutions is dried are provided within a machine frame 12 of the automatic processor 10. The processing section 11 has a developing tank 14, a fixing tank 16, and a washing tank 18 which are partitioned by partition walls 13 along the direction of travel of the photographic material (photographic film F).

An insertion rack 17 for drawing the film F into the automatic processor 10 is disposed in the vicinity of an insertion port 15 for the film F in the automatic processor 10.

In addition, an insertion detecting sensor 80 for detecting the film F being inserted is disposed in the vicinity of the insertion port 15. An insertion table for manually inserting the film F or an automatic feeder for automatically inserting the film F by a transporting means can be installed at the insertion port 15 of the automatic processor 10.

A developer is accommodated in the developing tank 14, in which a transporting rack 24 having nip-type transport rollers 22 for transporting the film F by being driven by an unillustrated motor is immersed in the developer. A fixer is accommodated in the fixing tank 16, in which a transporting rack 28 having nip-type transport rollers 26 for transporting the film F by being driven by an unillustrated motor is immersed in the fixer. In addition, washing water is stored in the washing tank 18, in which a transporting rack 32 having nip-type transport rollers 30 for transporting the film F by being driven by an unillustrated motor is immersed in the washing water.

Heat exchangers 19 are disposed below the developing tank 14 and the fixing tank 16, respectively. The developer in the developing tank 14 and the fixer in the fixing tank 16 flow respectively to the heat exchangers 19, and after being subjected to heat exchange there, the solutions flow back to the developing tank 14 and the fixing tank 16. As a result, the temperatures of the developer in the developing tank 14 and the fixer in the fixing tank 16 are maintained within predetermined ranges.

Crossover racks 34 are disposed over the partition wall between the developing tank 14 and the fixing tank 16 and over the partition wall between the fixing tank 16 and the washing tank 18. These crossover racks 34 are each provided with a pair of nip-type transport rollers 36 for transporting the film F from the upstream tank to the downstream tank in the direction of travel of the film F as well as guides 38 for guiding the film F.

Accordingly, the film F which has been inserted into the automatic processor 10 through the insertion port 15 is inserted into the developing tank 14 by means of the insertion rack 17 and is transported through the developer by means of the transport rollers 22 so as to be subjected to development. The film F thus developed is transported to the fixing tank 16 by means of the crossover rack 34. In the fixing tank 16, the film F is transported through the fixer by means of the transport rollers 26 so as to be subjected to fixing. The film F thus fixed is transported to the washing tank 18 by means of the crossover rack 34. In the washing tank 18, the film F is transported through the washing water by means of the transport rollers 30 so as to be subjected to washing. The film F is thus processed in the processing solutions.

An unillustrated solution-discharging pipe is fixed to the bottom of each of the developing tank 14, the fixing tank 16, and the washing tank 18, and a solution-discharging valve 21 is provided in each of these solution-discharging pipes. Accordingly, by opening these solution-discharging valves 21, it is possible to discharge the developer, the fixer, and the washing water respectively stored in the developing tank 14, the fixing tank 16, and the washing tank 18.

A squeeze rack 40 is disposed between the washing tank 18 and the drying section 20. This squeeze rack 40 has guides 43 for guiding the film F and squeeze rollers 42 for transporting the film F, on which the washing water has been attached, to the drying section 20 while squeezing the film F.

The drying section 20 comprises transport rollers 44 for transporting the film F, a drying fan 45 for supplying drying air, a chamber 46 incorporating a heater for heating the drying air, and a spray pipe 47 for spraying the heated drying air onto the film F and the transport rollers 44. In addition, the film F is transported diagonally upward in a turning section 48 disposed downstream from the transport rollers 44 in the transport path of the film F.

A receiving box 49 for accommodating the film F transported from the turning section 48 is disposed on the automatic processor 10 in such a manner as to project from an outer wall of the automatic processor 10.

As a result, the film F squeezed at the squeeze rack 40 is dried by drying air blown from the spray pipe 47 while the film F is being transported by the transport rollers 44 which are heated by the drying air in the drying section 20. Subsequently, the film F is turned in the turning section 48 and is then transported to the receiving box 49 so as to be accommodated therein.

A description will now be given of the structure for replenishing development replenishers and a fixing replenisher to the developing tank 14 and the fixing tank 16, respectively.

Figure 3:
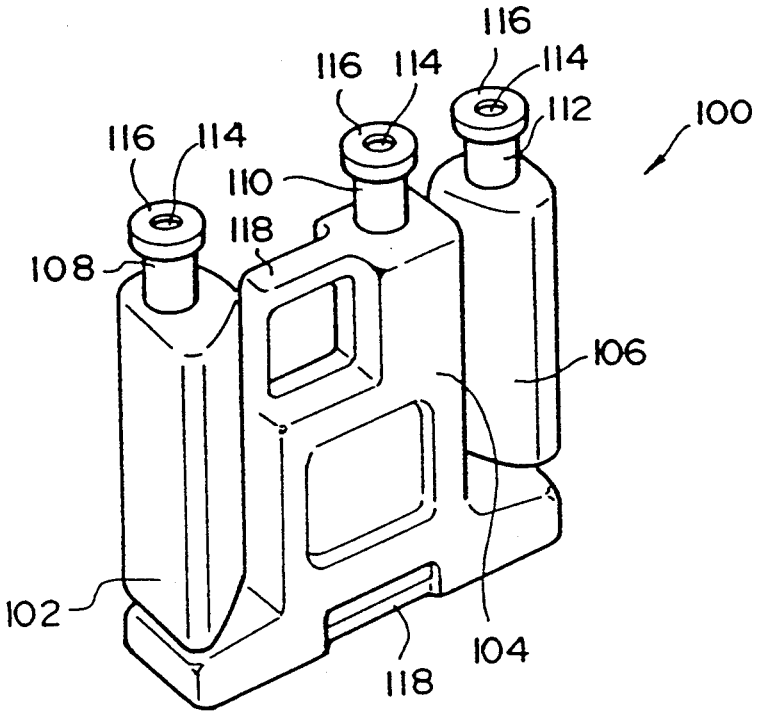
FIG. 3 is a perspective view of a cartridge for undiluted development replenishers.

As shown in FIG. 3, the development replenishers are filled and hermetically sealed in advance in a cartridge 100. The interior of this cartridge 100 is partitioned into three chambers by means of partition walls. An undiluted development replenisher A is filled in a first chamber 102, an undiluted development replenisher B is filled in a second chamber 104, and an undiluted development replenisher C is filled in a third chamber 106. Filling ports 108, 110, and 112 are provided in the cartridge 100 in correspondence with the first chamber 102, the second chamber 104, and the third chamber 106. These filling ports extend in the same direction, respectively. Packing 114 serving as a cover is provided at the open end of each of the filling ports 108, 110, and 112. This packing 114 closes each opening of the filling port 108, 110, and 112 by being held by each cap 116 threadedly secured to each of the filling ports 108, 110, and 112.

It should be noted that handles 118 for handling the cartridge 100 are provided on both the side of the cartridge 100 where the filling ports 108, 110, and 112 are disposed and the opposite side thereof.

Figure 4:
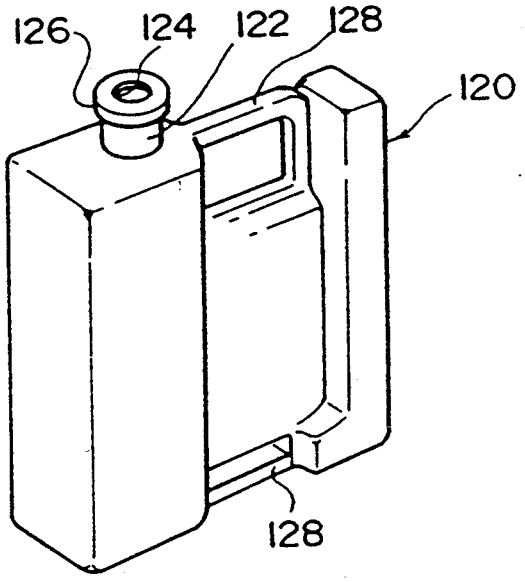
FIG. 4 is a perspective view of a cartridge for an undiluted fixing replenisher.

As shown in FIG. 4, the undiluted fixing replenisher is similarly filled and hermetically sealed in advance in a cartridge 120. A cylindrical filling port 122 is provided in the cartridge 120. Packing 124 is provided at the open end of this filling port 122. This packing 124 closes the opening of the filling port 122 by being held by a cap 126 threadedly secured to the filling port 122.

In this cartridge 120 as well, handles 128 for handling the cartridge 120 are provided on both the side of the filling port 122 and the opposite side thereof.

Figure 5:
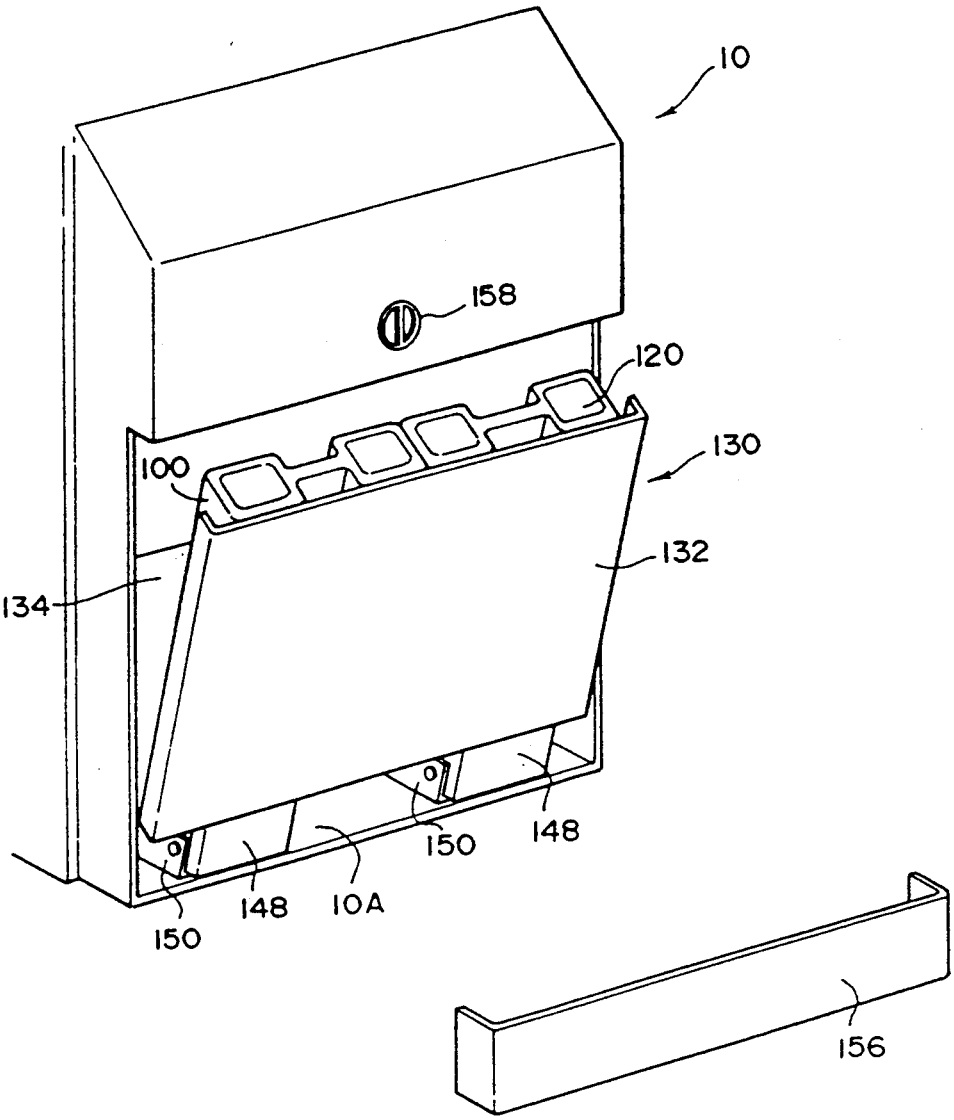
FIG. 5 is a perspective view of a cartridge loading section.

As shown in FIG. 5, the automatic processor 10 is provided with a cartridge loading section 130 for accommodating these cartridges 100 and 120 and for supplying the undiluted development replenishers and the undiluted fixing replenisher in the cartridges 100 and 120 to a stock tank 50 which will be described later.

With reference to FIGS. 5 to 10, a description will be given hereinafter of this cartridge loading section 130.

The cartridge loading section 130 is disposed on the machine frame 12 side. In this embodiment, the side where the cartridge loading section 130 is disposed in this side as viewed in FIG. 1. The loading section 130 comprises an outer panel 132 constituting a part of outer side walls of the automatic processor 10 as well as a cartridge receiver 134 secured to an inner side surface of this outer panel 132. This cartridge receiver 134 is formed into the configuration of a box whose upper side is open, and is formed into a size capable of accommodating the cartridges 100 and 120.

Figure 6A:
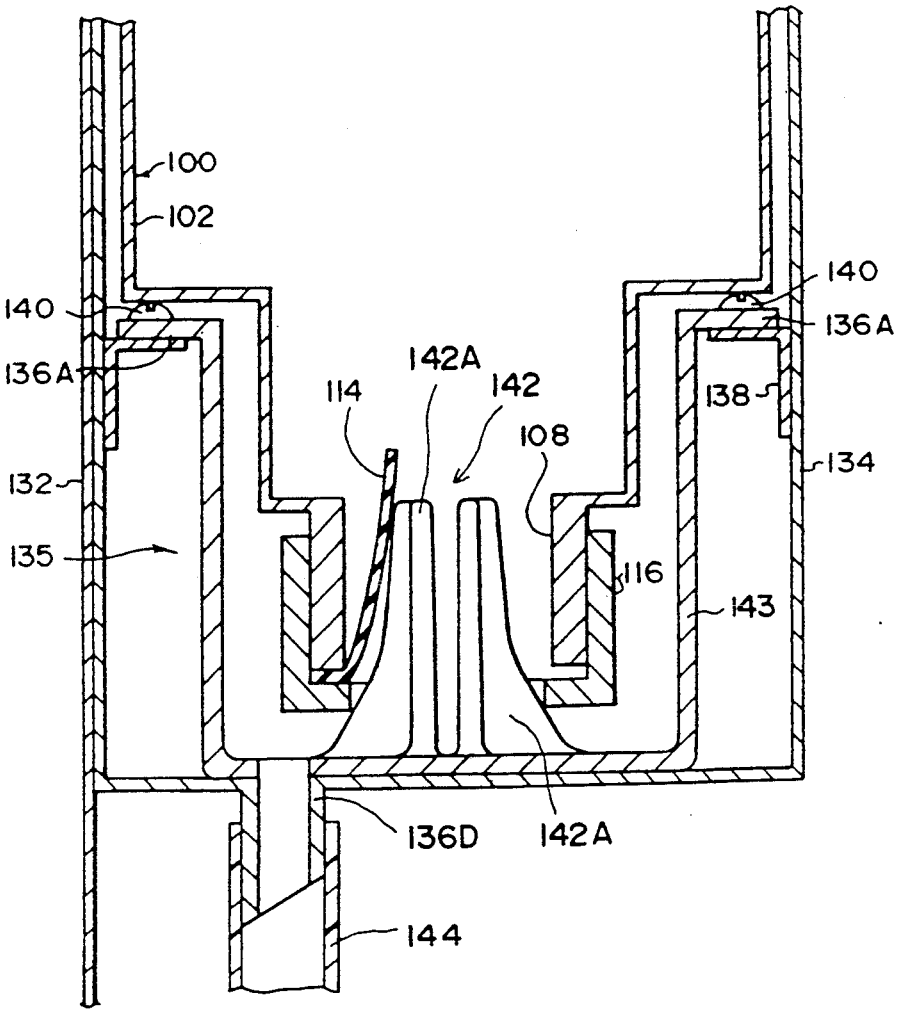
FIG. 6A is a cross-sectional view of a perforating section.

Perforating portions 135 are respectively formed in the bottom of the cartridge receiver 134 corresponding to the filling ports 108, 110, and 112 of the cartridges 100 and 120 that are accommodated (see FIG. 6A).

Figure 6B:
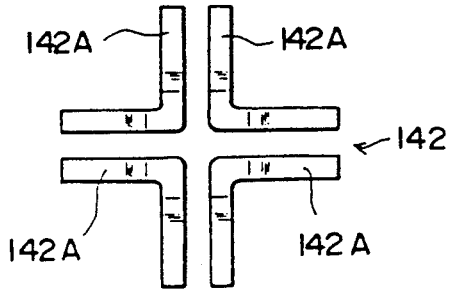
FIG. 6B is a plan view of a projection.
Figure 7:
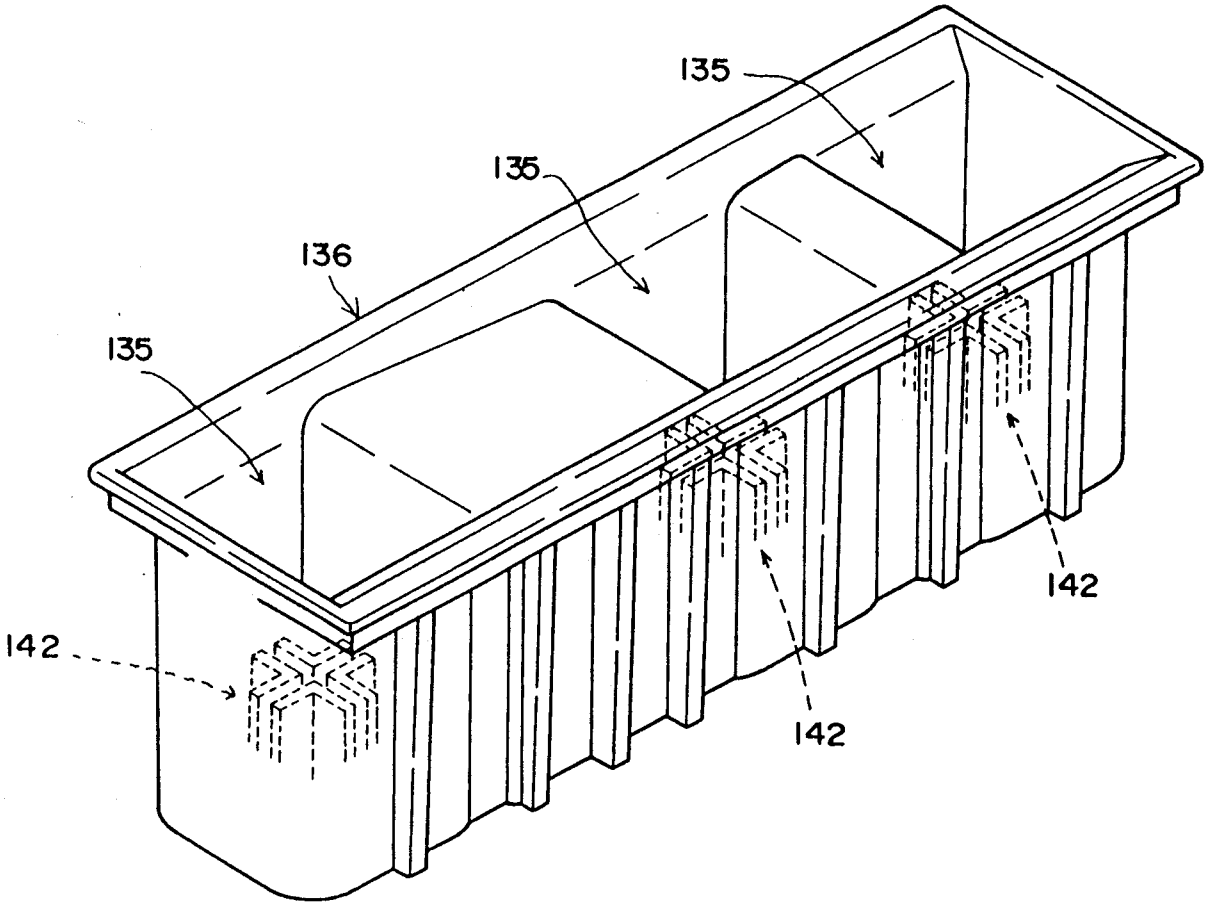
FIG. 7 is a cross-sectional view of a solution pan.
Figure 8:
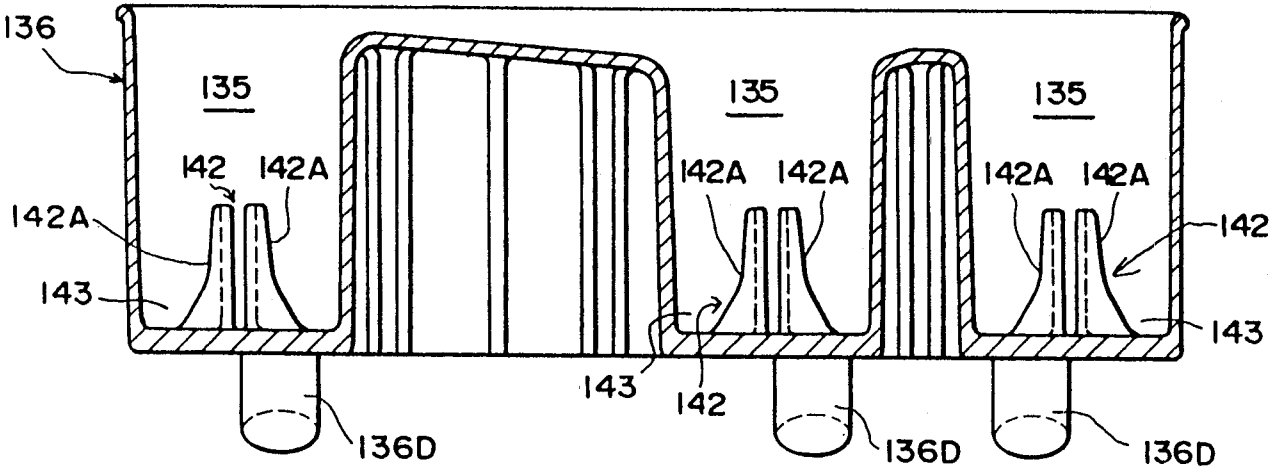
FIG. 8 is a side cross sectional view of the solution pan.

As shown in FIG. 6A, a solution pan 136 having a substantially inverted-hat-shaped configuration is disposed in each perforating portion 135. The solution pan 136 is secured by means of screws 140 via flanges 136A thereof to mounting brackets 138 affixed to side walls of the cartridge receiver 134. A projection 142 is provided in the center of the bottom 136B of the solution pan 136. This projection 142 is arranged by vertically disposing four tabular members 142A each having a substantially L-shaped configuration in a plan view, as shown in FIG. 6B, such that a substantially cross-shaped groove is formed in a plan view. Each tabular member 142A is configured in such a manner as to spread out gradually from a heightwise intermediate portion to a lower end thereof, and upper ends of the tabular members 142A are cut linearly so as to be flush within an identical plane. It should be noted that the projection 142 may be either secured to or placed on the bottom 136B.

A coupling pipe 136D serving as a pipe coupling is disposed to the side of the projection 142 at the bottom 136B of the solution pan 136. The coupling pipe 136D has an inner peripheral portion formed as a passage 136C, which penetrates a bottom wall of the cartridge receiver 134 and extends downward. One end of a flexible pipe 144 is fitted over the coupling pipe 136D, and the other end thereof communicates with the bottom of the stock tank 50 which will be described later. Accordingly, as for the cartridge 100 inserted into the cartridge receiver 134, the packing 114 of the filling port 108 corresponding to the first chamber 102 thereof is pushed upward into the cartridge 100 by means of the projection 142. As a result, the undiluted development replenisher A is supplied to the stock tank 50, which will be described later, through the passage 136C of the coupling pipe 136D and the pipe 144.

Although there are cases where the undiluted development replenisher A flows out to the solution pan 136 through the gap between the projection 142 and the cap 116, the cartridge receiver 134 is set at substantially the same level as that of the stock tank 50, so that the undiluted development replenisher A which has flown out into the solution pan 136 remains at a predetermined solution level.

Since the perforating portions 135 are provided in correspondence with the filling ports 108, 110, 112, and 122 of the cartridges 100 and 120, respectively, as described above, the undiluted development replenishers A, B, and C and the undiluted fixing replenisher in the cartridges 100 and 120 inserted into the cartridge receiver 134 are respectively supplied to the stock tank 50.

Figure 9:
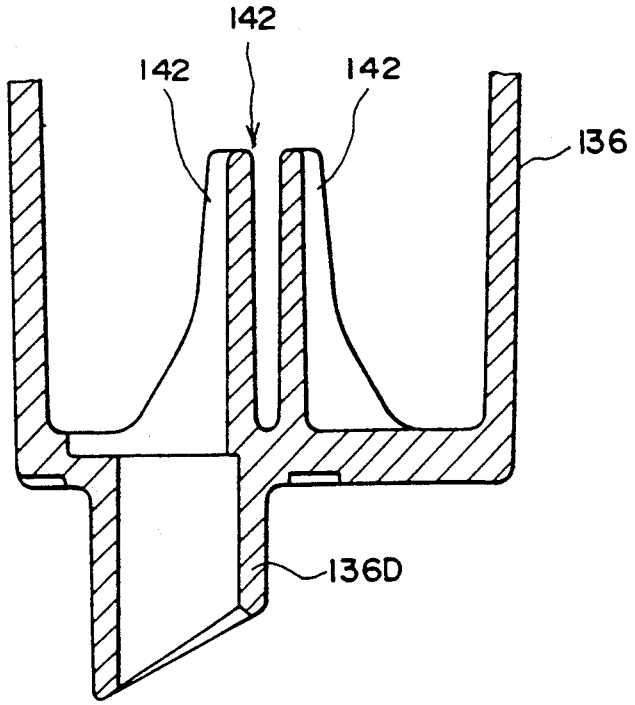
FIG. 9 is an enlarged view illustrating a configuration of a coupling pipe.

As shown in FIG. 9, a lower end of the coupling pipe 136D is cut in a slanted shape. That is, the opening surface of the coupling pipe 136D is cut diagonally with respect to a horizontal plane, and the distribution of pressure at this opening surface is rendered non-uniform. That is, since the surface tension at the opening end is prevented, when the undiluted replenisher flows from the solution pan 136 into the pipe 144 via the coupling pipe 136D, air which has entered the pipe 144 is vented from a portion where the pressure is low, thereby preventing an air lock.

In addition, an inner peripheral edge of the lower end of the coupling pipe 136D is provided with chamfering. For this reason, the opening area is enlarged, so that the diameter of the pipe is enlarged without altering the outer configuration of the pipe.

Figure 10:
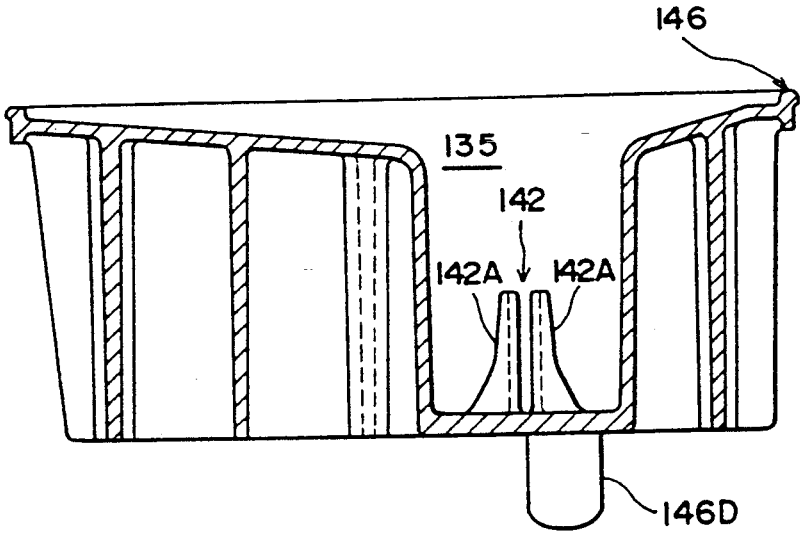
FIG. 10 is a side cross-sectional view of the solution pan for the cartridge for the undiluted fixing replenisher.

It should be noted that, as shown in FIG. 10, a solution pan 146, over which the cartridge 120 for the undiluted fixing replenisher is loaded, and a coupling pipe 146D are arranged in the same way as the above-described solution pan 136 except that a single perforating section 135 is provided. Accordingly, the portions of this solution pan 146 will be denoted by the same reference numerals, and a description of its arrangement will be omitted.

Figure 12:
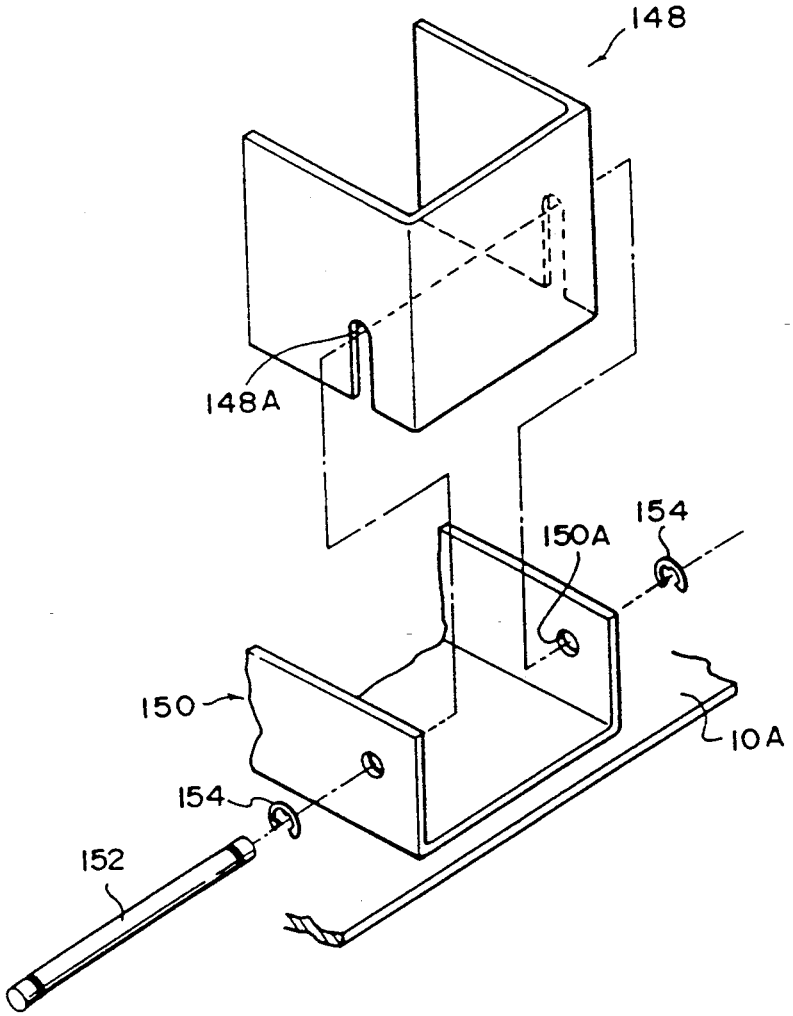
FIG. 12 is an exploded perspective view of a section for swinging the cartridge loading section.

The cartridge loading section 130 arranged as described above is supported swingably at a lower end of the outer panel 132. That is, as shown in FIG. 5, a pair of leg portions 148 are provided in such a manner as to project downward from the lower end of the outer panel 132. As shown in FIG. 12, these leg portions 148 are each formed of a plate material bent into a substantially U-shaped cross section, and a U-shaped slit 148A extending upward from its lower end is formed at each of the opposing walls thereof.

Meanwhile, a pair of receivers 150 secured to a bottom plate 10A of the automatic processor 10 which receives a lower portion of the leg portion 148, are mounted to a side portion of the main body of the automatic processor 10. Each of the receivers 150 has a substantially U-shaped cross section which is upwardly open. Through holes 150A are respectively formed in opposing walls thereof at mutually opposing positions. After a shaft member 152 is inserted through the through holes 150A, a pair of E-rings 154 are each fitted in an annular groove formed in a respective opposite end portion of the shaft member 152 at a position located in proximity to and on the outer side of the through hole 150A. Next, the cartridge loading section 130 is mounted in such a manner that the shaft member 152 enters the U-shaped slits 148A in the leg portion 148, thereby rendering the loading section 130 swingable. It should be noted that the cartridge loading section 130 may be arranged such that an elongated bolt is inserted through the through holes 150A, a nut threadedly engaged to the end of this elongated bolt, and the elongated bolt inserted into the U-shaped slits 148A in the leg portion 148.

In the automatic processor 10, a retaining member 158 is disposed above the loading section 130 for engaging an unillustrated retaining projection provided on the inner side of the outer panel 132 of the loading section 130 with the loading section 130 set in the closed state, so as to maintain the loading section 130 in the closed state. This retaining member 158 is disengaged from the retaining projection as the retaining member 158 is rotated by a predetermined angle. In addition, the interior of the cartridge receiver 134 of the loading section 130 and the interior of the automatic processor 10 are connected to each other by means of an unillustrated gas damper. This gas damper ensures that the cartridge loading section 130 can be swung smoothly from the closed state of the loading section 130, i.e., the state in which the cartridges 100 and 120, are accommodated, to the open state thereof, i.e., the state in which the cartridges 100 and 120 can be inserted or removed. At the same time, the gas damper is adapted to restrict the swinging motion of the loading section 130 to a predetermined angle.

Figure 11:
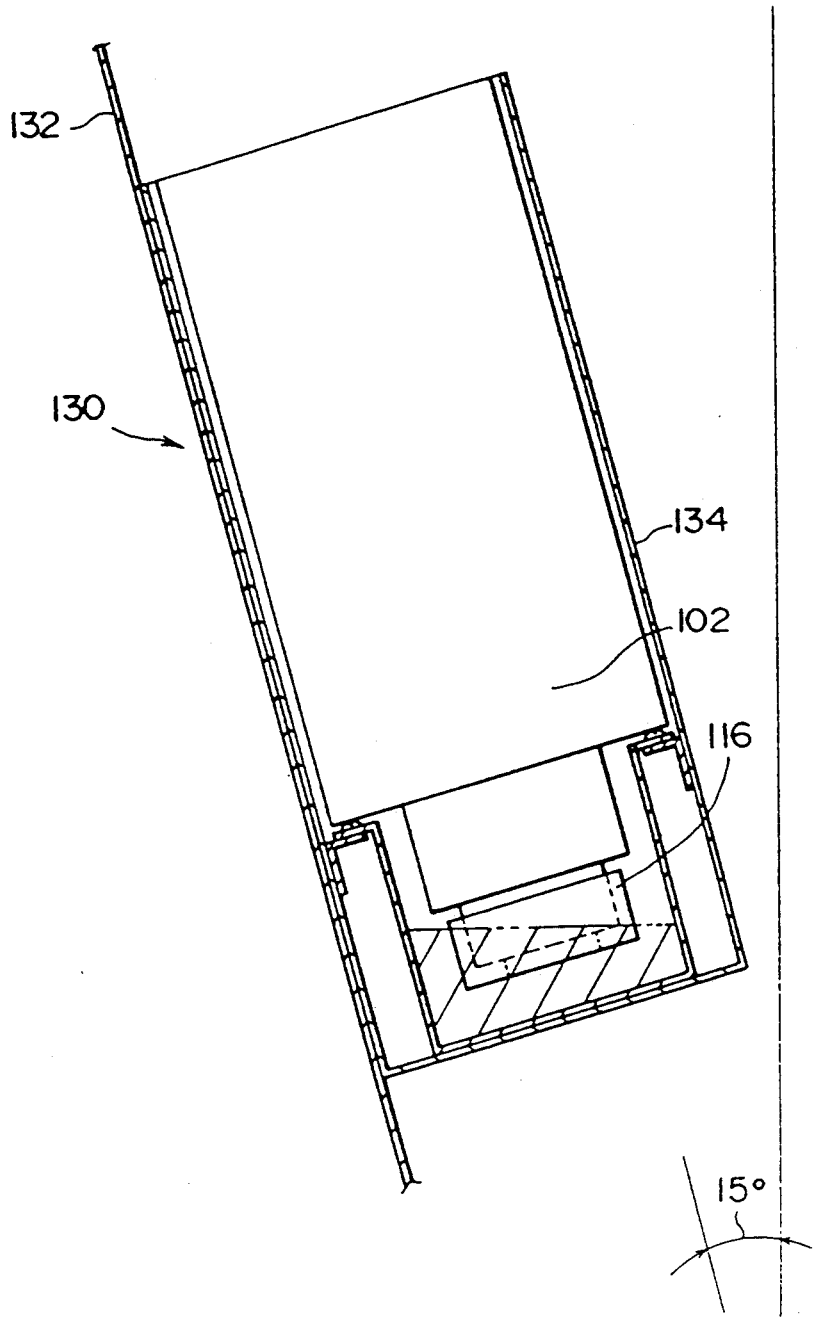
FIG. 11 is a cross-sectional view illustrating a state in which a perforating section has been swung.

It should be noted that the arrangement provided in this embodiment is such that when the loading section 130 is swung by 15° from the closed state, as shown in FIG. 11, the swinging motion is stopped by the gas damper. The restriction of the swinging motion is set by taking into consideration the bubbling up of the solutions remaining in the solution pans 136 at the time of the opening and closing of the loading section 130. However, the present invention is not restricted to this swinging angle.

In addition, a cover 156 for covering the leg portions 148 and the receivers 150 is provided below the cartridge loading section 130 of the automatic processor 10 so as to improve the outer appearance of the automatic processor 10, as shown in FIG. 5.

Furthermore, an unillustrated removable cover is provided on the side of the automatic processor 10 which is away from the side where the loading section 130 is disposed, so as to cover portions corresponding to the loading section 130 and a portion covered by the cover 156. On the inner side of this cover, the same type of receivers (not shown) as the receivers 150 are disposed on the bottom plate 10A of the automatic processor 10. Accordingly, the cartridge loading section 130 can be reinstalled to the later-mentioned side from the first-mentioned side of the automatic processor 10 by removing the unillustrated gas damper.

Figure 2:
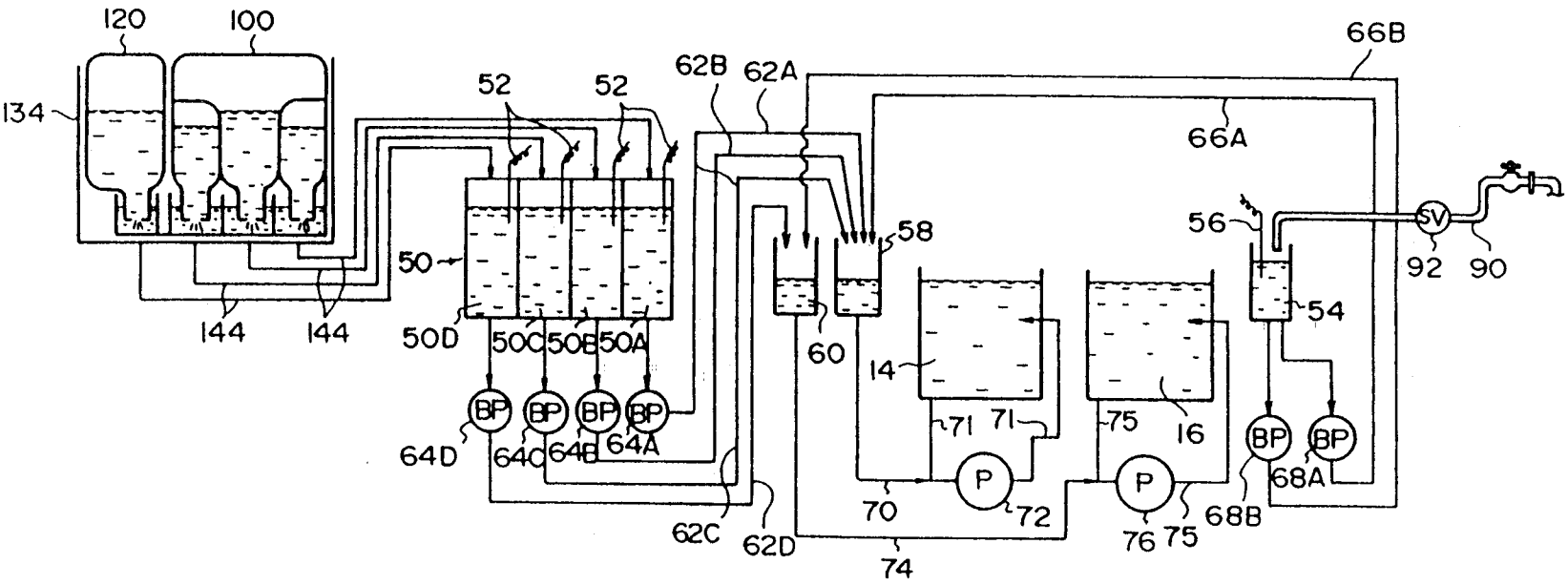
FIG. 2 is a systematic diagram for replenishing replenishing solutions.

The stock tank 50 is disposed on the bottom plate 10A of the automatic processor 10. As shown in FIG. 2, the stock tank 50 is partitioned into four tanks by means of partition walls. Among these tanks, a first tank 50A, a second tank 50B, and a third tank 50C are used for the undiluted development replenishers A, B, and C, respectively, while a fourth tank 50D is used for the undiluted fixing replenisher D. These tanks 50A to 50D are respectively provided with level sensors 52A, 52B, 52C, and 52D. Solution levels in the first tank 50A, second tank 50B, third tank 50C, and fourth tank 50D of the stock tank 50 are respectively detected by these level sensors 52A, 52B, 52C, and 52D so as to detect the remaining amounts of the undiluted replenishers in the cartridges 100 and 120, thereby making it possible to determine the timing of replacement of the cartridges 100 and 120.

Although in the above-described embodiment the stock tank 50 is provided with four tanks by being partitioned by partition walls, stock tanks may be provided separately in correspondence with the respective undiluted development replenishers A, B, C and the undiluted fixing replenisher.

A water supply tank 54, to which running water is supplied, is disposed in the automatic processor 10 on the side of the squeeze rack 40, shown in FIG. 1, which is away from this side as viewed in the drawing. This water supply tank 54 is also provided with a level sensor 56. The water level in the water supply tank 54 is detected by the level sensor 56, thereby making it possible to determine a timing for supplying running water.

Also disposed in the automatic processor 10 are a first mixing tank 58 for preparing the replenisher to be supplied to the developing tank 14 as well as a second mixing tank 60 for preparing the replenisher to be supplied to the fixing tank 16.

As shown in FIG. 2, the undiluted development fixings A, B, and C in the first tank 50A, second tank 50B, and third tank 50C of the stock tank 50 as well as running water in the water supply tank 54 are supplied to the first mixing tank 58. That is, one ends of pipelines 62A, 62B, and 62C communicate with the first tank 50A, second tank 50B, and third tank 50C, respectively, while the other ends of the pipelines 62A, 62B, and 62C respectively communicate with the first mixing tank 58. Bellows pumps 64A, 64B, and 64C are disposed at a midway position in the pipelines 62A, 62B, and 62C, respectively.

In addition, one end of a pipeline 66A communicates with the water supply tank 54, while the other end of the pipeline 66A communicates with the first mixing tank 58. A bellows pump 68A is disposed at a midway position in the pipeline 66A. Accordingly, when the bellows pump 64A, 64B, and 64C and the bellows pump 68A are operated, the undiluted development replenishers A, B, and C in the first tank 50A, second tank 50B, and third tank 50C as well as the running water in the water supply tank 54 are supplied to the first mixing tank 58 via the respective pipelines 62A, 62B, 62C, and 66A. In the mixing tank 58, the undiluted development replenishers A, B, and C are mixed and are diluted by the running water so as to be used as the replenisher to be supplied to the developing tank 14.

In addition, the undiluted fixing replenisher in the fourth tank 50D and the running water in the water supply tank 54 are supplied to the second mixing tank 60. That is, one end of a pipeline 62D communicates with the fourth tank 50D, while the other end of this pipeline 62D communicates with the second mixing tank 60. A bellows pump 64D is disposed at a midway position in the pipeline 62D. One end of a pipeline 66B communicates with the water supply tank 54, while the other end of the pipeline 66B communicates with the second mixing tank 60. A bellows pump 68B is disposed at a midway position in the pipeline 66B. Accordingly, when the bellows pumps 64D and 68B are operated, the undiluted fixing replenisher in the fourth tank 50D and the running water in the water supply tank 54 are supplied to the second mixing tank 60 via the pipelines 62D and 66B. In the mixing tank 60, the undiluted fixing replenisher is diluted by the running water so as to be used as the replenisher to be supplied to the fixing tank 16.

Opposite ends of a pipeline 71 for circulating the developer communicate with the developing tank 14, and a circulating pump 72 is disposed at a midway position in the pipeline 71. Here, one end of a pipeline 70 communicates with the first mixing tank 58, while the other end thereof communicates with a portion of the pipeline 71 which is upstream from the circulating pump 72. Accordingly, as the circulating pump 72 is operated, the replenisher mixed in the first mixing tank 58 is supplied to the development tank 14 via the pipeline 70 while being mixed with the developer circulating through the pipeline 71, so as to replenish the developer.

Opposite ends of a pipeline 75 for circulating the fixer communicate with the fixing tank 16. A circulating pump 76 is disposed at a midway position in the pipeline 75.

One end of a pipeline 74 communicates with the second mixing tank 60, while the other end thereof communicates with a portion of the pipeline 75 which is upstream from the circulating pump 76. Accordingly, as the circulating pump 76 is operated, the fixing replenisher mixed in the second mixing tank 60 is supplied to the fixing tank 16 via the pipeline 74 while being mixed with the fixer circulating through the pipeline 75, so as to replenish the fixer.

It should be noted that the water supply tank 54 and the washing tank 18 communicate with each other through an unillustrated pipeline, and the water supply tank 54 and the washing tank 18 are disposed such that their water levels become identical. The replenishment of the washing tank 18 with water is effected by opening and closing a solenoid valve 92 located at a midway position in a pipeline 90 disposed from a faucet for running water to the water supply tank 54 when the film F is detected by the insertion detecting sensor 80 disposed in the vicinity of the film insertion port 15 of the automatic processor 10 (see FIG. 1).

As shown in FIG. 1, the automatic processor 10 has a cleaning pump 78 for cleaning the crossover racks 34. This cleaning pump 78 causes the running water in the water supply tank 54 to be sprayed over the crossover racks 34 through an unillustrated spray pipe disposed at an upper end surface of the partition wall 13, so as to clean the crossover racks 34. It should be noted that an antibacterial agent is mixed in the cleaning water for the crossover racks 34 to prevent the clogging of the cleaning water discharging port of the unillustrated spray pipe due to water plants. The cleaning of the crossover racks 34 is effected upon completion of, for instance, a day's operation of the automatic processor 10.

Figure 13:
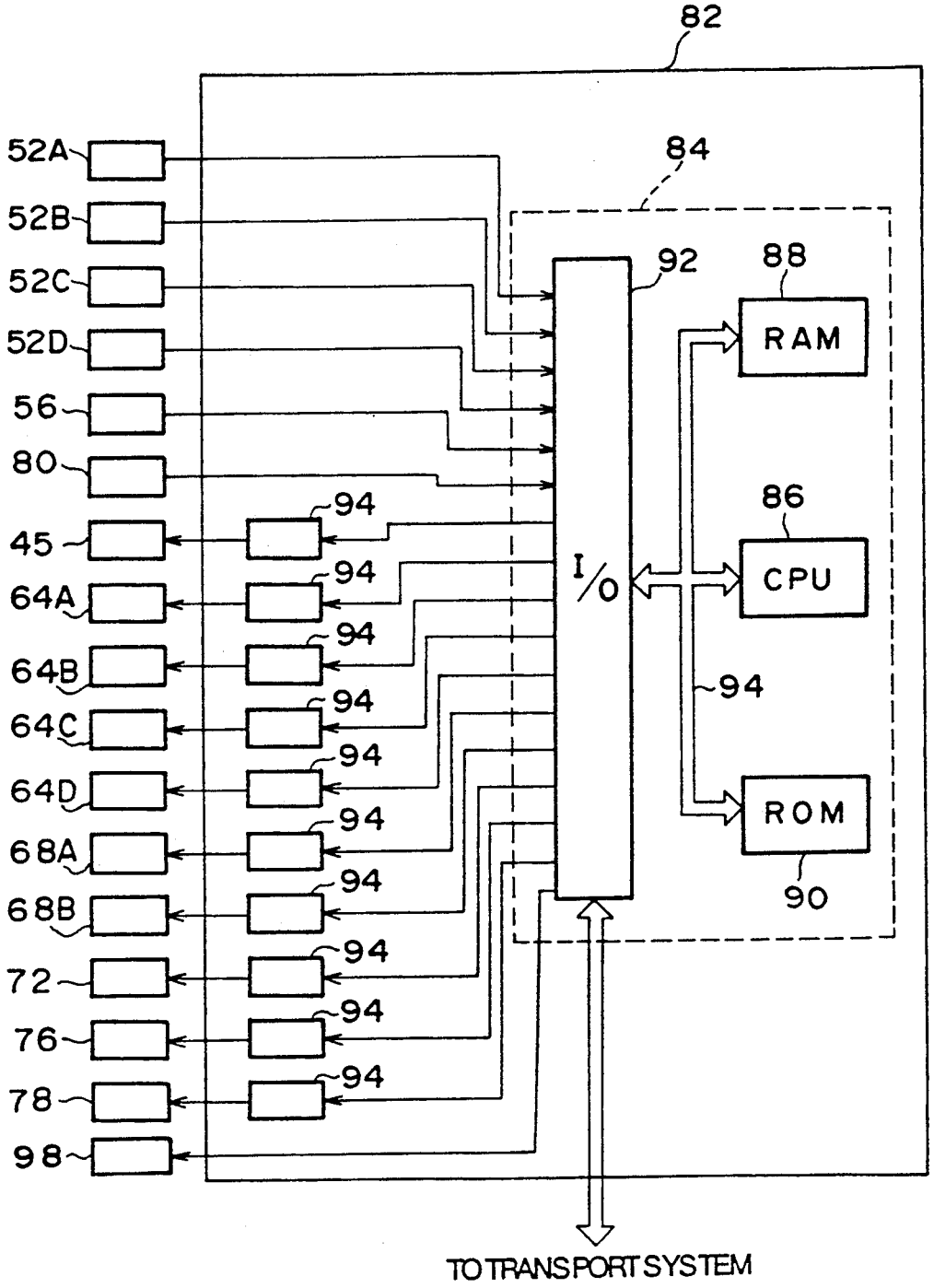
FIG. 13 is a control block diagram in accordance with an embodiment.

Referring now to FIG. 13, a description will be given of a controller 82.

The controller 82 comprises a microcomputer 84. The microcomputer 84 includes a CPU 86, a RAM 88, a ROM 90, input/output ports 92, and a bus 94 for connecting them, such as a data bus and a control bus.

The controller 82 controls the transport system for transporting the film F by driving the respective transport rollers. In addition, connected to the input/output ports 92 are the level sensors 52A, 52B, 52C, 52D, 56, and the insertion detecting sensor 80. Also, the fan 45, bellows pumps 64A, 64B, 64C, 64D, 68A, 68B, 68B, pump 72, circulating pump 76, and cleaning pump 78 are connected to the input/output ports 92 via drivers 94, respectively. An alarm 98 is also connected to the input/output ports of the controller 82. In the controller 82, this alarm 98 is controlled to issue an alarm when the amount of correction of the time (predetermined time) for driving the bellows pumps 64A, 64B, 64C, 64D in correspondence with the amount of the film F processed has exceeded a limit value.

The operation of this embodiment will be described hereafter.

First, a description will be given of the processing of the film F in the automatic processor 10.

The film F inserted into the automatic processor 10 is subjected to processing by the developer, fixer, and washing water, and is sent to the squeeze rack 40 so as to be squeezed. The squeezed film F is dried by the drying air heated by the drying section 20 and the transported by the heated transport rollers 44, and is accommodated in the receiving box 49 via the turning section 48. Thus pieces of the film F inserted into the automatic processor 10 are consecutively subjected to development and are accommodated in the receiving box 49.

A description will now be given of the replenishment of the replenishers.

The solution level of the developer is detected in correspondence with the amount of the film F processed or by an unillustrated level sensor disposed in the developing tank 14. The replenishment of the developing tank 14 with the development replenisher is effected in response to that information. As for this replenishment, the undiluted replenishers and water are supplied to the first mixing tank 58 as the bellows pumps 64A, 64B, 64C, and 68A are operated. These liquids, while being mixed, are supplied to the pipeline 71 for circulation by means of the pipeline 70. Accordingly, the occurrence of an unevenness of the developer during replenishment of the development replenisher in the developing tank 14 is prevented.

The fixing solution level is detected in correspondence with the amount of the film F processed or by an unillustrated level sensor disposed in the fixing tank 16. The replenishment of the fixing tank 16 with the fixing replenisher is effected in response to that information. As for this replenishment, the undiluted replenisher and water are supplied to the second mixing tank 60 as the bellows pumps 64D and 68B are operated. These liquids, while being mixed, are supplied to the pipeline 75 for circulation by means of the pipeline 74. Accordingly, the occurrence of an unevenness of the developer during replenishment of the fixing replenisher in the developing tank 14 is prevented.

When the amounts of the undiluted development replenishers A, B, and C and the undiluted fixing replenisher in the stock tanks 50A, 50B, 50C, and 50D have become less than the predetermined amounts due to the supply of these solutions to the first and second mixing tanks 58 and 60, the state is detected by the level sensors 52A to 52D, and the cartridges 100 and 120 are replaced.

The replacement of the cartridges 100 and 120 is effected as follows.

As the retaining member 158 located above the loading section 130 is rotated, the engagement of the retaining member 158 with the unillustrated retaining projection is released, so that the loading section 130 is in a swingable state and is swung from the closed state to the open state by the unillustrated gas damper. This swinging is smooth since the swinging speed is controlled by the gas damper. The swinging motion of the loading section 130 is stopped by the gas damper when the swinging motion has proceeded to 15° from the closed state. In this state, replacement of the cartridges 100 and 120 with new ones is possible. Subsequently, the outer panel 132 of the loading section 130 is pressed to cause the loading section 130 to swing in the reverse direction of the aforementioned direction, and the retaining member 158 and the unillustrated retaining projection are engaged with each other. In this manner, the replacement of the cartridges 100 and 120 is effected speedily.

If the bellows pumps 64A, 64B, 64C, and 64D are being driven properly, the level sensors 52A, 52B, 52C, and 52D are turned off at the same timing, i.e., the solution levels reach predetermined levels or less. However, if the flow rates of the bellows pumps 64A, 64B, 64C, and 64D vary due to factors ascribable to change with time, there are cases where the level sensor of one stock tank is turned off when the level sensors of the other stock tanks are still on.

Figure 14:
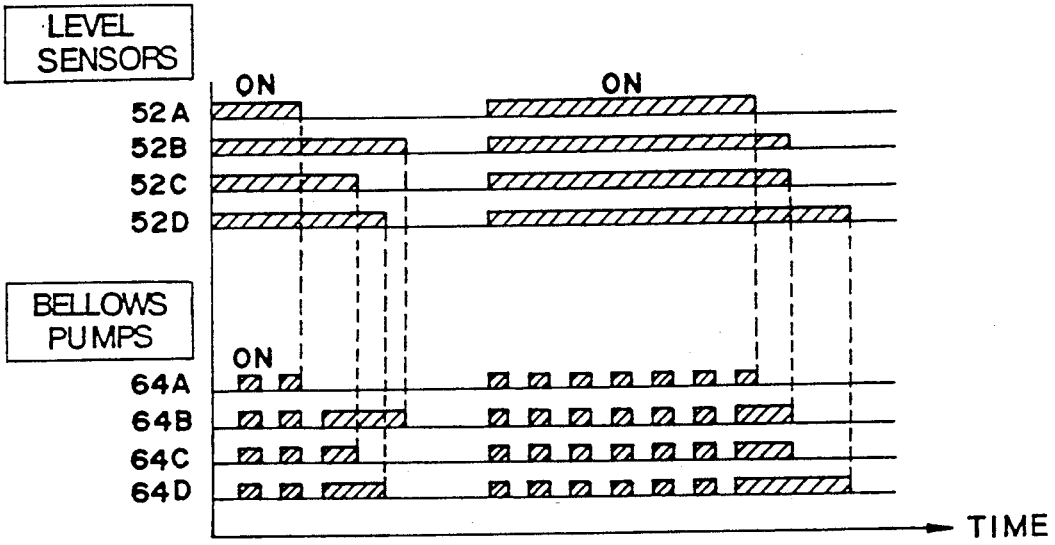
FIG. 14 is a timing chart for controlling the driving of pumps in accordance with the embodiment.

For this reason, in this embodiment, in order to correct this variation, pump drive correction control is carried out. Referring to a timing chart shown in FIG. 14, a description will be given hereafter of the procedure of the pump drive correction control.

First, the bellows pumps 64A, 64B, 64C, and 64D are factory adjusted to deliver fixed amounts per unit time. Here, a description will be given of a case where the flow rates of the bellows pumps 64B, 64C, and 64D have declined.

When the amounts of the undiluted replenishers in the cartridges 100 and 120 have decreased and solution levels have dropped below fixed levels, the level sensor 52A is turned off. In this state, the driving of the bellows pump 64A for the first tank 50A corresponding to the level sensor 52A which has been turned off is stopped, but the driving of the other bellows pumps 64B, 64C, and 64D is continued. Concurrently, timers for keeping the driving time of the respective bellows pumps 64B, 64C, and 64D are started, and the driving is continued until the level sensors 52B, 52C, and 52D corresponding to the respective bellows pumps 64B, 64C, and 64D are turned off. When the bellows pumps 64B, 64C, and 64D are turned off, the respective timers are stopped, and their stop timings are stored.

Then, the cartridges 100 and 120 are replaced. After the replacement operation has been carried out three times, one driving duration of each of the bellows pumps 64B, 64C, and 64D is corrected on the basis of an average value of stored data over the three operations. If this measure is adopted, errors are prevented from being added in a cumulative manner over time, and even if the pump flow rates decline, the amounts of the undiluted replenishers supplied can be held to substantially fixed levels.

In addition, in the abnormal event that the aforementioned corrected time has exceeded the previous driving time by more than 20%, or has exceeded an initial driving time by more than 20%, the abnormality is noted by sounding an alarm. That is, since the dislocation or disconnection (faulty contact) of the level sensor, leakage of the container itself, and the like are conceivable in addition to an abnormality ascribable only to the bellows pump, an alarm is sounded to prompt maintenance with respect to extreme errors. As a result, the faulty processing of the photosensitive material can be prevented. Here, 20% of the reference value can be altered, as necessary.

In addition, the change of the installing position of the cartridge loading section 130 is conducted as follows.

After removing the cover 156, the retaining member 158 is rotated to release its engagement with the unillustrated retaining projection, and the loading section 130 is swung out to its open position. Then, the cartridges 100 and 120 are drawn out from the cartridge receiver 134. In this state, as the loading section 130 is pulled upward, the engagement between the shaft member 152 and the leg portion 148 is canceled, and the gas damper is removed from the automatic processor 10.

Meanwhile, the unillustrated cover on the opposite side away from the side where the loading section 130 was installed is removed. On this opposite side, the loading section 130 is installed via the shaft member 152 and the gas damper, and the cartridges 100 and 120 are inserted into the cartridge receiver 134. Subsequently, the loading section 130 is closed, and the cover 156 is attached below the loading section 130. Then, the unillustrated cover which was attached to this opposite side is attached to the side where the loading section 130 was attached. Thus the change of the installing position of the loading section 130 is carried out.

Although in the above-described embodiment a description has been given of an example in which the present invention is applied to the automatic processor for X-ray films, the present invention is not restricted to the same, and is applicable to all the photographic processors including, for example, apparatuses for developing photographic films and apparatuses for developing photosensitive planographic printing plates.

It should be noted that although in this embodiment the excess driving time of the bellows pumps 64A, 64B, 64C, and 64D is measured to effect correction, flow rates may be measured directly by means of flow meters to correct the pump driving time in correspondence with a difference in the flow rate.

As described above, the replenisher suppling apparatus for a photographic processor in accordance with the present invention offers an outstanding advantage in that optimum processing solutions can be supplied to processing tanks by compensating for a decline in the flow rates of pumps and without causing an imbalance in the ratio of the undiluted replenishers.

What is claimed is:

1. A replenisher supplying apparatus for use in a photographic processor having a processing tank to which pieces of a photosensitive material are consecutively transported, and for supplying replenishers respectively stored in a plurality of stock tanks to said processing tank, said replenisher supplying apparatus comprising:

a plurality of level sensors respectively disposed in said plurality of stock tanks for respectively detecting liquid levels of the replenishers in said plurality of stock tanks;

a plurality of pumps disposed in correspondence with said plurality of stock tanks for supplying the replenishers from said plurality of stock tanks to said processing tank;

control means for controlling said plurality of pumps in such a manner as to supply a predetermined amount of each of the replenishers in correspondence with an amount of the photosensitive material processed, said control means being so arranged that when any of said plurality of level sensors has detected the liquid level being at a predetermined level or below, said control means stops the driving of said pump provided in said stock tank whose level sensor has detected the level being at the predetermined level or below, and said control means controls said pumps corresponding to said stock tanks in which remaining ones of said level sensors are disposed, in such a manner as to continuously drive latter-mentioned said pumps until the remaining ones of said level sensors detect a drop in the level to the predetermined level or below; and correcting means for correcting the flow rates of said pumps by measuring the amount of each of the replenishers supplied by said pumps during each of the continuous driving operations of said pumps and by acting on said control means on the basis of the measured amount of each of the replenishers.

2. A replenisher supplying apparatus according to claim 1, wherein said correcting means is provided with timer means for measuring a time duration of each of said pumps driven continuously, and the amount of each of the replenishers supplied during the continuous driving operation is obtained by the time duration.

3. A replenisher supplying apparatus according to claim 1, wherein said correcting means is provided with flow meters for measuring respective amounts of the replenishers supplied by said pumps to detect the amount of each of the replenishers supplied during the continuous driving operation.

4. A replenisher supplying apparatus according to claim 2, wherein said correcting means is provided with storage means for storing the time measured by said timer means, and the amount of each of the replenishers supplied during each of the continuous driving operations is determined by storing continuously a plurality of times the time durations measured by said timer means and on the basis of an average value of the time durations measured the plurality of times.

5. A replenisher supplying apparatus according to claim 1, wherein said control means controls the amount of each of the replenishers to be supplied by an operating time of each of said pumps.

6. A replenisher supplying apparatus according to claim 5, wherein said correcting means corrects the operating time of each of said pumps.

7. A replenisher supplying apparatus according to claim 5, wherein said control means controls the operating time of each of said pumps on the basis of the times of intermittent operations of each of said pumps.

8. A replenisher supplying apparatus according to claim 6, further comprising alarm means for issuing an alarm when the corrected operating time of each of said pumps has exceeded a first predetermined time limit.

9. A replenisher supplying apparatus according to claim 8, wherein said alarm means issues an alarm when a newly corrected pump operating time has exceeded a corrected pump operating time set on the basis of the pump operating time corrected previously.

10. A replenisher supplying apparatus according to claim 8, wherein said alarm means issues an alarm when a time corrected by said correcting means a plurality of times has exceeded a second predetermined time limit.

11. A replenisher supplying apparatus according to claim 1, further comprising a cartridge accommodating section for accommodating a plurality of cartridges respectively filled with the replenishers, so as to respectively supply the replenishers from said cartridges to said plurality of stock tanks.

12. A replenisher supplying apparatus according to claim 11, wherein said cartridge accommodating section accommodates a cartridge having a plurality of partitioned chambers filled with predetermined amounts of the replenishers in correspondence with the replenishers, and the supply of the replenishers is effected from said cartridge.

13. A replenisher supplying apparatus for use in a photographic processor having a processing tank to which pieces of a photosensitive material are consecutively transported, and for supplying replenishers respectively stored in a plurality of stock tanks to said processing tank, said replenisher supplying apparatus comprising:

a plurality of level sensors respectively disposed in said plurality of stock tanks for respectively detecting liquid levels of the replenishers in said plurality of stock tanks;

a plurality of pumps disposed in correspondence with said plurality of stock tanks and for supplying the replenishers from said plurality of stock tanks to said processing tank;

control means for controlling said plurality of pumps in such a manner as to drive said plurality of pumps for a predetermined time set in correspondence with an amount of the photosensitive material processed, said control means being so arranged that when any of said plurality of level sensors has detected the liquid level being at a predetermined level or below, said control means stops the driving of said pump provided in said stock tank whose level sensor has detected the level being at the predetermined level or below, and said control means controls said pumps corresponding to said stock tanks in which remaining ones of said level sensors are disposed, in such a manner as to continuously drive latter-mentioned said pumps until the remaining ones of said level sensors detect a drop in the level to the predetermined level or below;

a timer for measuring a time duration of each of said pumps driven continuously; and correcting means for correcting the predetermined time for driving each of said pumps on the basis of the time duration measured by said timer.

14. A replenisher supplying apparatus according to claim 13, further comprising alarm means for issuing an alarm when the corrected predetermined time has exceeded a first predetermined time limit.

15. A replenisher supplying apparatus according to claim 14, wherein said alarm means issues an alarm when a newly corrected predetermined time has exceeded a second time limit set on the basis of the predetermined time corrected previously.

16. A replenisher supplying apparatus according to claim 13, wherein said alarm means issues an alarm when a predetermined time corrected a plurality of times by said correcting means has exceeded a third predetermined time limit set on the basis of the predetermined time.

17. A replenisher supplying apparatus according to claim 13, further comprising a cartridge accommodating section for accommodating a plurality of cartridges respectively filled with predetermined amounts of the replenishers, and the supply of the replenishers is effected from said cartridges.

18. A replenisher supplying apparatus according to claim 13, wherein said cartridge accommodating section accommodates a cartridge having a plurality of partitioned chambers filled with predetermined amounts of the replenishers in correspondence with the replenishers, and the supply of the replenishers is effected from said cartridge.

19. A replenisher supplying apparatus for use in a photographic processor having a processing tank to which pieces of a photosensitive material are consecutively transported, and for supplying replenishers respectively stored in a plurality of stock tanks to said processing tank, said replenisher supplying apparatus comprising:

a plurality of level sensors respectively disposed in said plurality of stock tanks for respectively detecting liquid levels of the replenishers in said plurality of stock tanks;

a plurality of pumps disposed in correspondence with said plurality of stock tanks and for supplying the replenishers from said plurality of stock tanks to said processing tank;

control means for controlling said plurality of pumps in such a manner as to drive said plurality of pumps for a predetermined time set in correspondence with an amount of the photosensitive material processed, said control means being so arranged that when any of said plurality of level sensors has detected the liquid level being at a predetermined level or below, said control means stops the driving of said pump provided in said stock tank whose level sensor has detected the level being at the predetermined level or below, and said control means controls said pumps corresponding to said stock tanks in which remaining ones of said level sensors are disposed, in such a manner as to continuously drive latter-mentioned said pumps until the remaining ones of said level sensors detect a drop in the level to the predetermined level or below;

a timer for measuring a time duration of each of said pumps driven continuously;

storage means for storing the time duration measured by said timer; and correcting means for correcting the predetermined time for driving each of said pumps when an average value of the successive time durations measured the plurality of times and stored in said storage means has exceeded a set time.

20. A replenisher supplying apparatus according to claim 19, further comprising alarm means for issuing an alarm when the corrected predetermined time has exceeded a predetermined time limit.

* * * * *